US006354071B2

(12) United States Patent
Tegel et al.

(10) Patent No.: US 6,354,071 B2
(45) **Date of Patent: *Mar. 12, 2002**

(54) MEASUREMENT METHOD FOR DETECTING AND QUANTIFYING COMBUSTOR DYNAMIC PRESSURES

(75) Inventors: Daniel Robert Tegel, Simpsonville, SC (US); Gerald P. Hunt, Cohoes, NY (US); Jack Edward Lawton, Gloversville, NY (US); Robert Edward Malo, Waterford, NY (US)

(73) Assignee: General Electric Company, Schenectady, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/160,666

(22) Filed: Sep. 25, 1998

(51) Int. Cl.[7] ..... F01D 25/24; F23R 3/52; F02C 3/00

(52) U.S. Cl. ..... 60/39.02; 60/725; 60/39.33; 431/114

(58) Field of Search ..... 60/39.02, 39.33, 60/725, 39.091, 760; 431/114

(56) References Cited

U.S. PATENT DOCUMENTS

| | | | | | |
|---|---|---|---|---|---|
| 3,635,018 | A | * | 1/1972 | De Corso et al. | 60/39.091 |
| 3,798,626 | A | * | 3/1974 | Weichbrodt et al. | 340/669 |
| 4,364,260 | A | * | 12/1982 | Chen et al. | 73/35.03 |
| 4,557,106 | A | * | 12/1985 | Williams et al. | 60/39.281 |
| 4,643,023 | A | * | 2/1987 | Capps | 73/117.3 |
| 4,872,312 | A | * | 10/1989 | Iizuka et al. | 60/760 |
| H1006 | H | * | 12/1991 | Zwicke | 364/551.01 |
| 5,706,643 | A | * | 1/1998 | Snyder et al. | 60/39.06 |
| 5,784,300 | A | * | 7/1998 | Neumeier et al. | 702/106 |
| 5,784,889 | A | * | 7/1998 | Joos et al. | 60/725 |
| 5,797,266 | A | * | 8/1998 | Brocard et al. | 60/725 |
| 5,847,353 | A | * | 12/1998 | Titus et al. | 219/121.36 |

FOREIGN PATENT DOCUMENTS

| | | | | |
|---|---|---|---|---|
| JP | 6-26402 | * | 2/1994 | 60/725 |

* cited by examiner

*Primary Examiner*—Ted Kim
(74) *Attorney, Agent, or Firm*—Nixon & Vanderhye P.C.

(57) ABSTRACT

A method of detecting combustor dynamic pressures in combustors of a gas turbine combustor includes the steps of: a) mounting at least one accelerometer (24) on a combustor casing; b) establishing a baseline vibration signature for the casing when combustion dynamics are minimal; and c) measuring subsequent vibration signatures and comparing those signatures to the baseline signature.

9 Claims, 2 Drawing Sheets

MEASUREMENT METHOD FOR DETECTING AND QUANTIFYING COMBUSTOR DYNAMIC PRESSURES

BACKGROUND OF THE INVENTION

This invention relates to turbomachinery and, more particularly, to a method for detecting and quantifying combustor dynamic pressures.

Excessive dynamic pressures (or dynamics) within Dry Low $NO_x$ (DLN) combustion systems must be avoided in order to assure acceptable system durability and reliability. As DLN combustion systems become more aggressive with regard to emissions and gas turbine cycles, the combustors tend to become less robust against these combustor dynamic pressure fluctuations (dynamics), and system failures caused by excessive dynamics are possible. In some cases, continuous monitoring of combustor dynamics with internally mounted dynamic pressure transducers is required as an instantaneous warning system. Dynamic pressure transducers are expensive, however, and require continuous maintenance monitoring. Additionally, since dynamic pressure transducers are mounted internally of the pressure vessels, replacement of the transducers requires shutdown and subsequent cooling of the machine.

BRIEF SUMMARY OF THE INVENTION

This invention provides a method of detecting combustor dynamic pressures from outside of the pressure vessel, so that continuous operation of a gas turbine is not effected by instrumentation related problems, maintenance or other concerns.

In an exemplary embodiment, an accelerometer is mounted externally on each combustor casing and measures a vibration signature for that casing, and thus detects and quantifies combustor dynamic pressures for that specific combustor. The advantages of this technique include: (a) all instrumentation is mounted external to the pressure vessel, allowing online maintenance without a turbine shutdown; (b) the long term reliability of accelerometers leads to a permanent dynamics pressure measurement system; and (c) it is less expensive than currently used PCB probes mounted internally of the combustor casing.

In order to implement the method, it is required that a baseline combustor case vibration signature be recorded for comparison purposes. Thus, a vibration signature is recorded when it is known that combustor dynamics are minimal, such as during a diffusion flame mode. By continuously measuring subsequent vibration signatures through all load ranges, and comparing them to the baseline, the onset of excessive combustor dynamics can be detected.

Accordingly, in its broader aspects, the present invention relates to a method of detecting combustor dynamic pressures in combustors of a gas turbine combustor comprising: a) mounting at least one accelerometer on a combustor casing; b) establishing a baseline vibration signature for the casing when combustion dynamics are minimal; c) measuring subsequent vibration signatures for the casing and comparing those signatures.

DETAILED DESCRIPTION OF THE DRAWINGS

Figure 1:
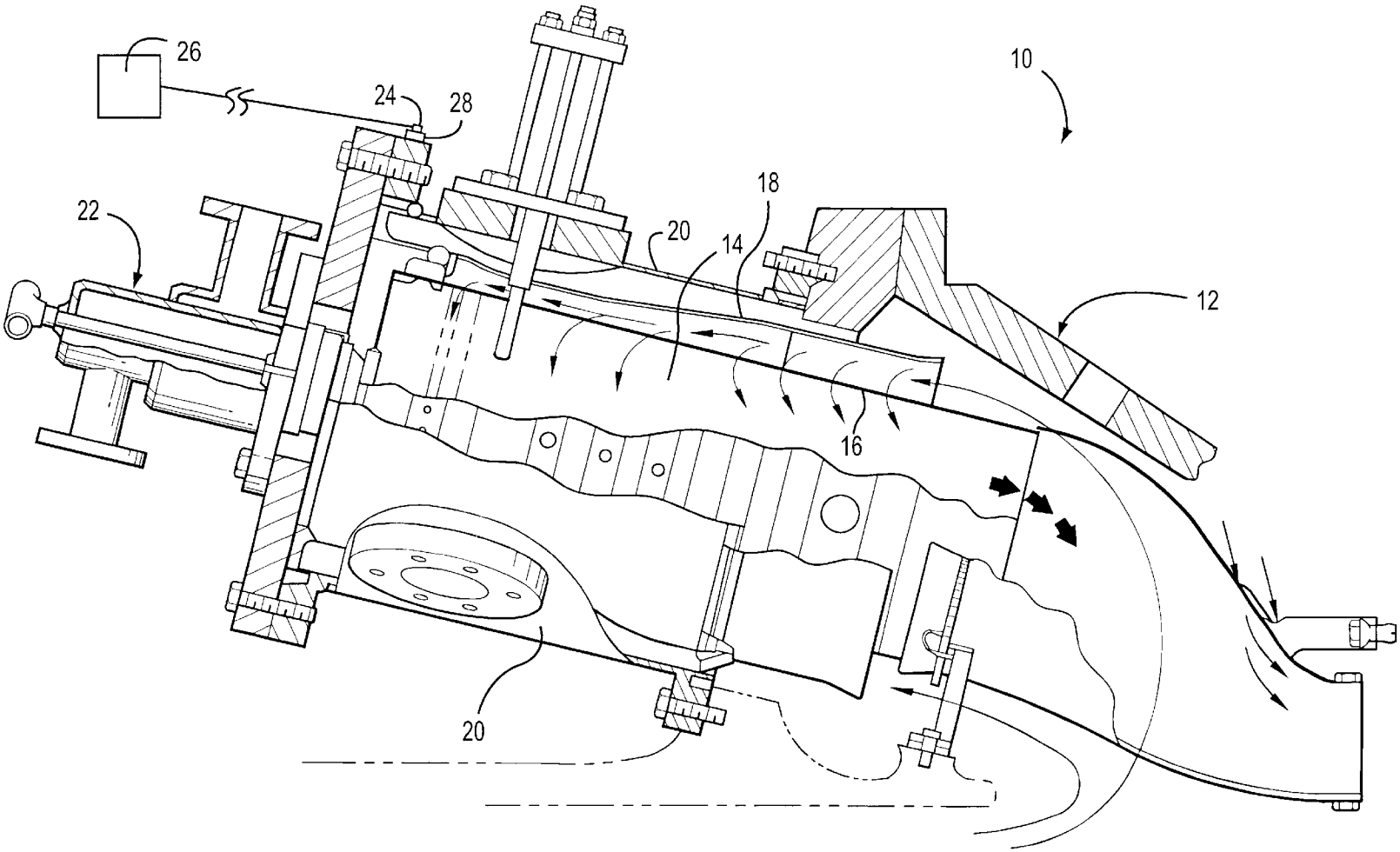
FIG. 1 is a section taken through an individual combustor of the type employed in a gas turbine.

A typical gas turbine may include a multi-stage compressor, multiple (e.g., six, ten, fourteen, etc.) combustors (oriented in a circular array about the rotor), and a three stage turbine. The combustor 10 includes a combustion chamber 14 surrounded by a slot-cooled liner assembly 16 which, in turn, is enclosed partially within a flow sleeve 18. The liner assembly 16 and flow sleeve 18 are enclosed within a cylindrical combustor casing 20. A fuel nozzle assembly 22 is mounted at the rear of the casing 20, and supplies fuel to the combustion chamber. Compressor discharge air is supplied to the combustor for reverse flow between the flow sleeve and liner and into the combustion zone or chamber. This configuration is a typical combustor in gas turbines manufactured by the assignee of the invention. The invention is particularly applicable, but not limited to, dry low $NO_x$ combustors. The combustor shown is not a dry low $NO_x$ combustor but is nevertheless instructive with respect to the mounting of an accelerometer on a combustor casing as described in greater detail below.

In accordance with this invention, the combustor dynamic pressures are measured from outside the combustor casing. More specifically, in the preferred arrangement, an accelerometer 24 is mounted on the external surface of the casing 20, and is connected to a microprocessor (and a monitor or panel) 26 where the casing signatures are displayed, e.g., plotting vibration amplitude vs. frequency. In a preferred arrangement, one accelerometer is attached to each combustor casing of the turbine. This is presently implemented by welding a block 28 to a flange of the casing 20 and attaching the accelerometer 24 to the block 28. The latter is merely an optional mounting interface, however, and may be omitted where appropriate. The accelerometer itself may be any suitable commercially available accelerometer, for example, the ENDEVCO Model 2276 high temperature accelerometer. The accelerometer 24 is preferably oriented to measure vibrations in the radially outward direction.

The location of the accelerometer on the combustor casing is not critical but it may be desirable to uniformly locate the accelerometers on all combustor casings to the extent possible. Generally, the location of the accelerometers is dictated by accessibility.

Figure 2:
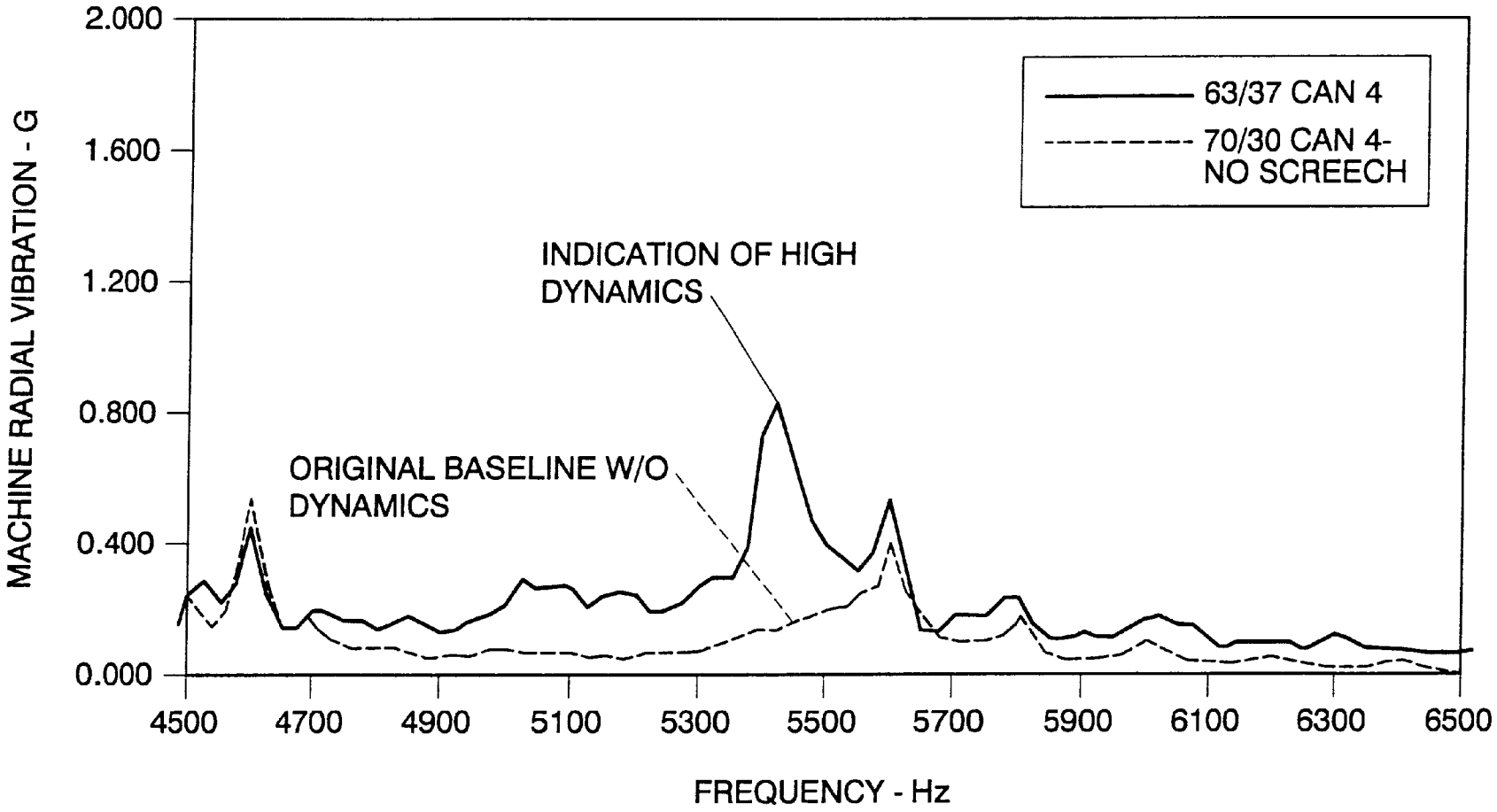
FIG. 2 is a plot illustrating case vibration vs. frequency for a combustor when significant combustor dynamics do not exist, and measurements taken when a 5400 Hz combustor dynamics tone has been created.

FIG. 2 shows a baseline or reference plot (in dashed lines) of vibration amplitude vs. frequency for a combustor casing when there are minimal combustor dynamics. FIG. 2 also shows a similar plot (in solid line) for the same combustor casing, but when a 5400 Hz combustor tone has been created, simulating combustor dynamics under load. The original baseline plot shows a pair of vibration peaks at about 4600 Hz and about 5600 Hz. The subsequent plot for the same combustor shows a marked increase in peak vibrations at about 5400 Hz. Thus, by identifying anomalies or significant changes in signatures, the onset of excessive combustor dynamics can be detected from the accelerometer readings.

In use, threshold ranges can be established for combustor dynamics so that the operator can identify circumstances under which the unit must be shut down in order to avoid catastrophic failure, or less critical situations which require further monitoring. In the latter case, the operating conditions of the machine may be varied to bring the vibration level to within an acceptable range.

Prior readings for the same combustor casing under similar conditions using conventional internal dynamic pressure transducers validate the efficacy of the theory that combustor dynamics signatures are transmitted to the combustor case, and hence measurable by external accelerometers to determine the combustor dynamics in the combustor.

The arrangement according to this invention is particularly advantageous since it permits continuous monitoring of combustion dynamics with external access to the accelerometers. This means that if one or more of the accelerometers fail, they can be replaced without shutting down the turbine. The accelerometers are also more reliable and less expensive than the conventional internal dynamic pressure transducers.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of detecting combustor dynamic pressures in combustors of a gas turbine combustor wherein the combustors are enclosed within an external casing, and each combustor is partially defined by a combustion liner that is partially surrounded by a flow sleeve, the method comprising:

a) mounting at least one accelerometer on an external surface of the external combustor casing;

b) establishing a baseline vibration signature for the casing when the gas turbine combustor is in a diffusion flame mode when combustion dynamics are minimal; and c) measuring subsequent vibration signatures for the external casing when the gas turbine combustor is under load and comparing those signatures to said baseline signature to identify anomalies in said subsequent vibration signatures and thus detect onset of excessive combustor dynamic pressures.

2. The method of claim 1 wherein said vibration signatures comprise a plot of vibration amplitude vs. frequency.

3. The method of claim 1 wherein at least one accelerometer is mounted on each combustor casing of the gas turbine.

4. The method of claim 1 including the step of:

d) displaying the baseline and subsequent vibration signatures on a screen.

5. The method of claim 4 wherein steps a), b), c) and d) are carried out for each combustor in the gas turbine.

6. The method of claim 1 wherein step a) is carried out by securing a block on the combustor casing and attaching the accelerometer to the block.

7. The method of claim 1 wherein an accelerometer is mounted on each combustor of the gas turbine, and wherein each accelerometer is oriented to measure vibrations in a radially outward direction.

8. A method of detecting combustor dynamic pressures in combustors of a gas turbine combustor comprising:

a) mounting at least one accelerometer on a combustor casing;

b) establishing a baseline vibration signature for the casing when combustion dynamics are minimal; and c) measuring subsequent vibration signatures and comparing those signatures to said baseline signature;

wherein step a) is carried out by securing a block on the combustor casing and attaching the accelerometer to the block; and wherein the accelerometer is oriented to measure vibrations in a radially outward direction.

9. A method of detecting combustor dynamic pressures in combustors of a gas turbine combustor comprising:

a) mounting at least one accelerometer on a combustor casing;

b) establishing a baseline vibration signature for the casing when combustion dynamics are minimal; and c) measuring subsequent vibration signatures and comparing those signatures to said baseline signature;

wherein an accelerometer is mounted on each combustor of the gas turbine, and wherein each accelerometer is oriented to measure vibrations in a radially outward direction; and further wherein step b) is carried out when the gas turbine combustor is in a diffusion flame mode, and wherein step c) is carried out when the gas turbine combustor is under load.

* * * * *